US009872598B2

(12) United States Patent
Thayyullathil et al.

(10) Patent No.: US 9,872,598 B2
(45) Date of Patent: Jan. 23, 2018

(54) DRYING SYSTEM FOR A DISHWASHER

(75) Inventors: Jemsheer Thayyullathil, Greenwood, MS (US); Kevin Brown, Greenwood, MS (US)

(73) Assignee: VIKING RANGE, LLC, Greenwood, MS (US)

( * ) Notice: Subject to any disclaimer, the term of this patent is extended or adjusted under 35 U.S.C. 154(b) by 1919 days.

(21) Appl. No.: 13/176,951

(22) Filed: Jul. 6, 2011

(65) Prior Publication Data

US 2013/0008474 A1 Jan. 10, 2013

(51) Int. Cl.
*A47L 15/48* (2006.01)

(52) U.S. Cl.
CPC ..... *A47L 15/488* (2013.01); *A47L 15/48* (2013.01); *A47L 15/483* (2013.01); *A47L 15/486* (2013.01)

(58) Field of Classification Search
CPC ..... A47L 15/48; A47L 15/483; A47L 15/486; A47L 15/488
USPC ..... 134/56 D, 57 D, 58 D, 95.2
See application file for complete search history.

(56) References Cited

U.S. PATENT DOCUMENTS

| | | | |
|---|---|---|---|
| 3,068,877 | A | 12/1962 | Jacobs |
| 3,542,594 | A | 11/1970 | Smith et al. |
| 3,876,469 | A | 4/1975 | Schimke |
| 4,097,099 | A | 6/1978 | Spiegel |
| 4,097,307 | A | 6/1978 | Geiger |
| 4,179,821 | A | 12/1979 | Herbst et al. |
| 4,392,891 | A | 7/1983 | Meyers |
| 4,448,359 | A | 5/1984 | Meyers |
| 4,510,991 | A | 4/1985 | Kawahira |
| 4,657,036 | A | 4/1987 | Yake |
| 4,673,441 | A | 6/1987 | Mayers |
| 4,709,488 | A | 12/1987 | Anselmino et al. |
| 4,972,861 | A | 11/1990 | Milocco et al. |
| 5,056,543 | A | 10/1991 | Dygve |
| 5,143,306 | A | 9/1992 | Nilsson |
| 5,165,435 | A | 11/1992 | Thies et al. |
| 5,330,580 | A | 7/1994 | Whipple, III et al. |
| 5,333,631 | A | 8/1994 | Kirkland et al. |
| 5,337,500 | A | 8/1994 | Enokizono |
| 5,345,957 | A | 9/1994 | Cooper et al. |
| 5,355,900 | A | 10/1994 | Sakata |

(Continued)

FOREIGN PATENT DOCUMENTS

| | | | |
|---|---|---|---|
| CH | 694 495 | A5 | 7/1999 |
| DE | 3025311 | A1 | 1/1982 |

(Continued)

OTHER PUBLICATIONS

"Fundamentals of Adhesion," DuraTech Industries, www.duratech.com, Rev. Jun. 2006.

*Primary Examiner* — Levon J Shahinian
(74) *Attorney, Agent, or Firm* — Baker, Donelson, Bearman, Caldwell & Berkowitz, PC; Dorian Kennedy

(57) ABSTRACT

A drying system for a dishwasher including a passive vent assembly mounted to a top portion of the dishwasher. The passive vent assembly includes a passive vent structure having a series of air vents defined therein and through which drying air flows are drawn into the wash chamber of the dishwasher, a diffuser mounted over the air vents and including a series of fins for spreading the drying air flows across the wash chamber, and a moisture trap hood mounted over an upper surface of the passive vent structure.

14 Claims, 3 Drawing Sheets

(56) References Cited

U.S. PATENT DOCUMENTS

| | | | |
|---|---|---|---|
| 5,408,716 | A | 4/1995 | Dausch et al. |
| 5,409,309 | A | 4/1995 | Giddings et al. |
| 5,474,378 | A | 12/1995 | Smith et al. |
| 5,628,334 | A | 5/1997 | Edwards et al. |
| 5,657,878 | A | 8/1997 | Austin |
| 5,660,195 | A | 8/1997 | Taylor, Jr. et al. |
| 5,700,329 | A | 12/1997 | Edwards et al. |
| 5,725,001 | A | 3/1998 | Vogel |
| 5,755,244 | A | 5/1998 | Sargeant et al. |
| 5,762,080 | A | 6/1998 | Edwards et al. |
| 5,792,276 | A | 8/1998 | Driessen |
| 5,803,985 | A | 9/1998 | Alvord |
| 5,836,324 | A | 11/1998 | Johnson et al. |
| 5,849,101 | A | 12/1998 | Edwards et al. |
| 5,860,716 | A | 1/1999 | Good et al. |
| 5,881,746 | A | 3/1999 | Buser et al. |
| 5,909,743 | A | 6/1999 | Thies et al. |
| 5,957,144 | A | 9/1999 | Neff et al. |
| 5,971,513 | A | 10/1999 | Cassalia |
| 5,975,124 | A | 11/1999 | Stevens, II |
| 6,007,640 | A | 12/1999 | Neff et al. |
| 6,103,017 | A | 8/2000 | Thies et al. |
| 6,138,692 | A | 10/2000 | Kobos et al. |
| 6,182,674 | B1 | 2/2001 | Jozwiak et al. |
| 6,247,771 | B1 | 6/2001 | Miller |
| 6,293,289 | B1 | 9/2001 | Hapke et al. |
| 6,432,216 | B1 | 8/2002 | Thies |
| 6,454,872 | B1 | 9/2002 | Miller et al. |
| 6,471,467 | B1 | 10/2002 | Pagalday |
| 6,605,157 | B2 | 8/2003 | Hegeman |
| 6,622,754 | B1 | 9/2003 | Roth et al. |
| 6,623,565 | B2 | 9/2003 | Rosenbauer et al. |
| 6,694,990 | B2 | 2/2004 | Spanyer et al. |
| 6,698,438 | B2 | 3/2004 | Hegeman et al. |
| 6,755,490 | B2 | 6/2004 | Welch et al. |
| 6,782,899 | B2 | 8/2004 | Kim et al. |
| 6,790,290 | B2 | 9/2004 | Durfee |
| 6,832,617 | B2 | 12/2004 | Hegeman et al. |
| 6,928,752 | B2 | 8/2005 | Johnson et al. |
| 7,252,101 | B2 | 8/2007 | Elick et al. |
| 7,513,933 | B2 | 4/2009 | Coppom et al. |
| 7,798,157 | B2 | 9/2010 | Kim |
| 7,887,643 | B2 | 2/2011 | Stelzer et al. |
| 7,909,936 | B2 | 3/2011 | Lau et al. |
| 7,909,939 | B2 | 3/2011 | Brewer et al. |
| 2003/0140947 | A1 | 7/2003 | Han et al. |
| 2003/0213505 | A1 | 11/2003 | Price et al. |
| 2004/0163686 | A1 | 8/2004 | Kang |
| 2004/0163690 | A1 | 8/2004 | Kim |
| 2004/0173245 | A1 | 9/2004 | Elick et al. |
| 2005/0274036 | A1 | 12/2005 | Osvatic et al. |
| 2005/0284507 | A1 | 12/2005 | Boesche |
| 2006/0090778 | A1 | 1/2006 | Oakes et al. |
| 2006/0231122 | A1 | 10/2006 | Stelzer et al. |
| 2006/0236556 | A1 | 10/2006 | Ferguson et al. |
| 2006/0237035 | A1 | 10/2006 | Ferguson |
| 2006/0237036 | A1 | 10/2006 | Picardat |
| 2006/0237042 | A1 | 10/2006 | Weaver |
| 2006/0237048 | A1 | 10/2006 | Weaver |
| 2006/0237049 | A1 | 10/2006 | Weaver |
| 2006/0237050 | A1 | 10/2006 | Weaver et al. |
| 2006/0237052 | A1 | 10/2006 | Picardat |
| 2008/0206092 | A1 | 8/2008 | Crapser et al. |
| 2008/0250928 | A1 | 10/2008 | DeSalvo et al. |
| 2009/0038653 | A1 | 2/2009 | Kang |
| 2009/0318621 | A1* | 12/2009 | Posch et al. ..... 525/240 |
| 2010/0156259 | A1 | 6/2010 | May et al. |

FOREIGN PATENT DOCUMENTS

| | | | |
|---|---|---|---|
| DE | 102 33 278 | A1 | 2/2004 |
| EP | 0 848 930 | A2 | 6/1988 |
| EP | 0 455 151 | A1 | 11/1991 |
| EP | 0 838 192 | A1 | 4/1998 |
| FR | 1 561 549 | | 3/1969 |
| FR | 2 156 412 | | 5/1973 |
| GB | 2 200 834 | A | 8/1988 |
| JP | 2004-294208 | | 10/2004 |
| WO | WO 2005/089621 | A1 | 9/2005 |

* cited by examiner

DRYING SYSTEM FOR A DISHWASHER

FIELD OF THE INVENTION

The present invention generally relates to dishwashers and similar automatic cleaning systems, and in particular to a drying system for a dishwasher, which drying system is designed to facilitate the drying of dishes within the dishwasher in a more efficient manner.

BACKGROUND OF THE INVENTION

Dishwashers are a modern convenience in almost every home in the United States and many other countries for washing and cleaning dishes. Modern dishwashers typically have a number of convenience settings or features for scrubbing and cleaning dishes, including heavily soiled dishes, pots and pans, as well as cleaning more delicate dishes and cookware, such as fine china and crystal. Increasingly, as with other household appliances, there is a growing demand to make dishwashers faster and significantly more energy efficient in their operation. During the typical dishwashing cycle, the dishwashers will heat and pump water, generally mixed with a cleaning solution or soap, into a spray arm that applies the cleaning solution, as well as rinse water at the dishes under pressure, after which the dishes are subjected to a drying cycle in which heated air is applied to the dishes to dry and remove water therefrom.

Such water heating and drying cycles typically consume significant amounts of energy necessary to heat the water for washing and rinsing to a temperature sufficient to clean the dishes and to draw a sufficient volume of air through the wash tub of the dishwasher to sufficiently dry the dishes. Additionally, the drying cycle further often can take a significant amount of time to properly dry the dishes without spotting, which increased operation time requires more energy the longer it runs. Still further, the addition of drying chemicals generally is required to reduce spotting during drying. Accordingly, many companies are attempting to develop ways of cutting the washing and drying cycle times so as to reduce the amount of energy required during such operation, but at the same time, the dishwashers still must clean and dry dishes effectively. This includes being able to dry the dishes within the dishwasher as quickly and completely as possible, but without leaving water spots that can occur with direct air flows or flash drying of the dishes.

Accordingly, it can be seen that a need exists for a dishwasher design that addresses the foregoing and other related and unrelated problems in the art.

SUMMARY OF THE INVENTION

Briefly described, the present invention generally relates to a drying system for facilitating the rapid and efficient drying of dishes within a dishwasher while reducing incidence of spotting or flash drying of the dishes, and without requiring additional power for its operation. The drying system generally includes a passive vent assembly including a passive vent structure that is sandwiched between a moisture trap hood or cover and a diffuser mounted on opposite sides thereof.

The passive vent structure generally is a substantially U-shaped or C-shaped structure having a body generally formed from a material having a low surface energy. For example, various plastics such as polyethylene, polypropylene, polystyrene, polyvinyl acetate, ethylene-vinyl acetate or other similar low surface energy plastic materials. Alternatively, materials coated with a low surface energy material such as Teflon®, Tedlar® or various waxes or acrylic paints or adhesives also can be used. The body of the passive vent structure includes an outwardly flaring open front end through which a drying airflow is received from the ambient environment outside the dishwasher, and a generally arcuate or curved rear portion having a vent section formed therein.

The vent section generally is circular, although it can be formed in a variety of different configurations, and typically is recessed into the body, with its lower surface or edge projecting downwardly from the body of the passive vent structure and into the wash chamber of the dishwasher to which the passive vent assembly is applied. A plurality of air vents or inlets are formed through the vent section, each of which generally will include a tapering side wall. An upper vent opening is defined at the end of each air inlet side wall, and a lower vent opening is formed at the lower end of each air inlet side wall. The upper vent openings generally will be of a smaller size than the lower vent openings, with the side walls defining tapered air flow passages through the vent section for the drying airflow to be introduced into the wash chamber of the dishwasher.

The diffuser is mounted to the lower surface of the passive vent structure body, typically by snap connectors or other similar connectors or fasteners. The diffuser generally includes a series of fins or baffles that define openings therebetween and typically are arranged at varying angles of between approximately 10° to 80° with respect to a vertically aligned central axis extending through the center of the diffuser and vent section of the passive vent structure. It will also be understood that greater or lesser angles of the fins or baffles also can be used, so as to vary the angle(s) at which the airflows are received from the air inlets or vents of the vent section of the passive vent structure and are directed into the wash chamber. As a result, the incoming drying airflows are spread or diffused over a wider area of coverage within the wash chamber, thus promoting more turbulence and faster condensation of moisture and drying of the dishes therein.

The moisture trap hood is received over the upper surface of the passive vent structure, covering the upper surface and being spaced therefrom. As a result, an airflow opening or inlet is defined/formed at the front end of the passive vent assembly for guiding the incoming drying airflows into the vent section of the passive vent structure. The moisture trap hood further generally helps hold in moist, heated air from the wash chamber of the dishwasher, facilitating more rapid condensation of the water therein, which water is collected and flows back into the air vents to help in the creation or formation of a moisture barrier or substantial seal across the openings of the vents of the passive vent structure.

During the washing and rinse cycles of a cleaning operation as a higher pressure is maintained within the wash chamber of the dishwasher, the use of the low surface energy plastic or coated materials for the passive vent structure, in combination with the construction of the air vents thereof, facilitates the formation of water beads or bubbles covering the lower vent openings thereof so as to create a substantial moisture seal or barrier across the air vents or inlets. The air vents thus will be effectively sealed against both the ingress of ambient air from outside the dishwasher, as well as the release or escape of hot, moist air or water vapor from inside the wash chamber of the dishwasher.

Thereafter, during a drying cycle, when the blower of the dishwasher is engaged, and the pressure within the wash chamber is lowered, the water bubbles will be broken or otherwise disturbed, causing the drying airflows to be drawn into and through the air vents of the passive vent assembly and into the wash chamber. As the drying airflows pass through the air vents of the vent section of the passive vent structure, they strike the fins or baffles of the diffuser, which cause the incoming airflows to be diffused and spread out across the wash chamber. The system thus enables the cold air to enter into the wash chamber from the top of the wash chamber through the vent using forced suction created at the bottom of the wash chamber using a blower. Based on the principle that hot air rises, when the drying cycle starts, the hot and moist air in the tub or wash chamber will tend to try to rise and stay at the top and will urge the incoming cold, drier air toward the bottom of the wash chamber. This movement of air will create turbulence of the air flow in the wash chamber, and the diffuser will spread the incoming cold air so that the turbulence of the air flow within the wash chamber in the system generally is further amplified. This creates greater turbulence and a wider flow of air throughout the wash chamber, which can help facilitate the rapid condensation and removal of water and water vapor from the dishes so as to provide enhanced and greater efficiency in the drying cycle for the dishes.

Those skilled in the art will appreciate that the above-stated advantages and other advantages and benefits of various embodiments of the invention upon reading the following detailed description of the embodiments, with reference to the below-listed figures.

According to common practice, the various features of the drawings discussed below are not necessarily drawn to scale. Dimensions of various features and elements in the drawings may be expanded or reduced to more clearly illustrate the embodiments of the disclosure.

Corresponding parts additionally are designated by corresponding reference numbers throughout the drawings.

DETAILED DESCRIPTION OF THE INVENTION

Figure 1:
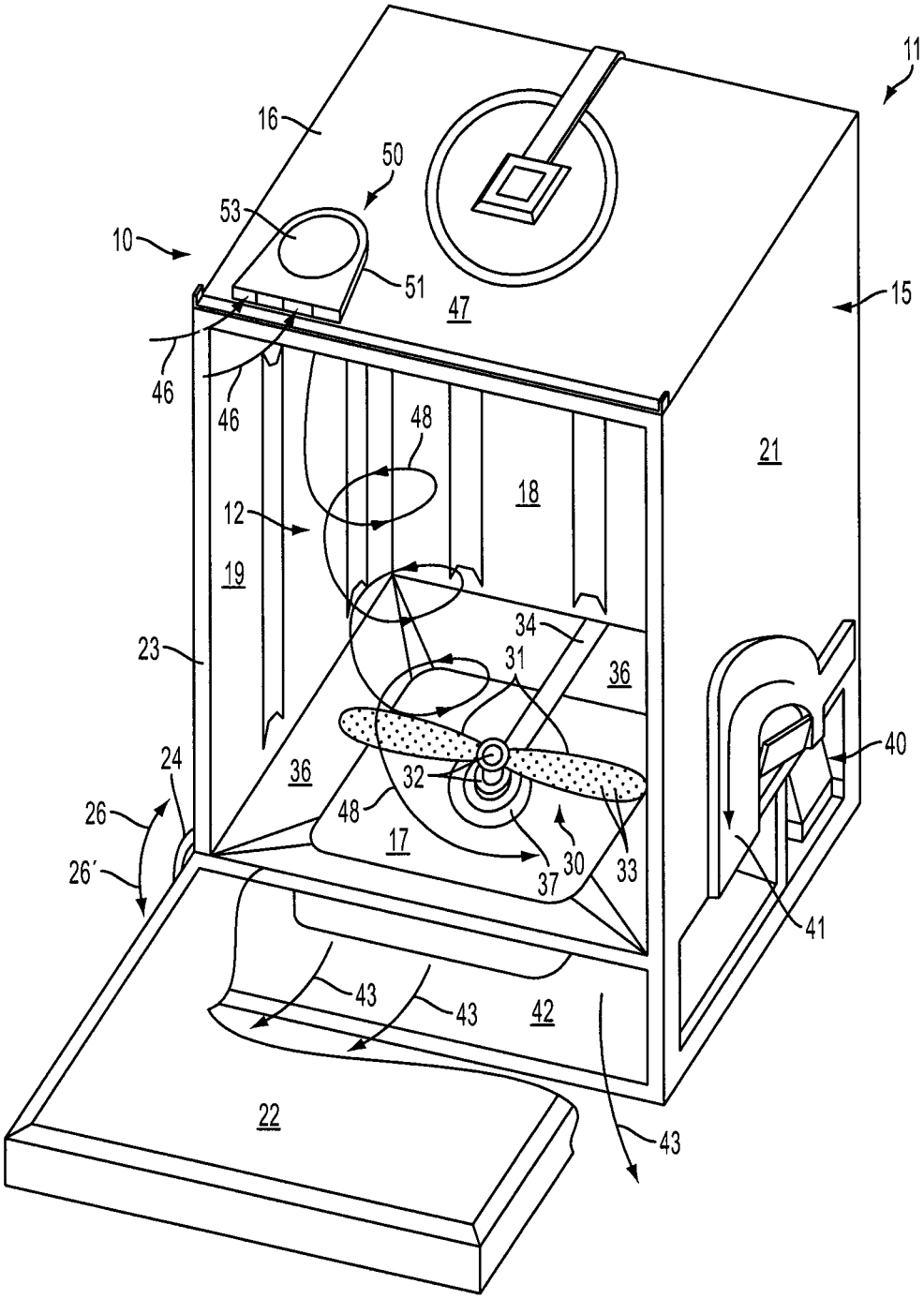
FIG. 1 is a perspective view of one embodiment of a dishwasher incorporating the drying system of the present invention.

Referring now to the drawings in which like numerals indicate parts throughout the several views, FIG. 1 generally illustrates a drying system 10 for a dishwasher 11, for facilitating the rapid and efficient drying of dishes within the wash chamber 12 or tub of the dishwasher, without requiring additional power for its operation. The drying system of the present invention is designed to provide enhanced air flow through and across the wash chamber to aid in the rapid drying of dishes therein, while reducing or substantially eliminating flash drying or spotting on the dishes.

As illustrated in FIG. 1, the dishwasher 11 generally includes a cabinet 15 having a top wall 16, a bottom 17, a rear wall 18, and side walls 19 and 21. The top, bottom, rear and side walls of the cabinet define the open ended wash chamber or tub 12 in which dishes are received, typically on racks (not shown) for cleaning. A door 22 generally is pivotally mounted to the open front side 23 of the dishwasher cabinet 15, such as by hinges 24 (only one of which is shown for clarity). The door 22 thus is pivotable as indicated by arrows 26/26' so as to move the door from an open position for loading dishes within the wash chamber, as generally illustrated in FIG. 1, to a closed position covering the front side 23 of the dishwasher cabinet 15 for sealing the wash chamber during a cleaning cycle.

At least one spray arm 30 is mounted within the wash chamber for applying heated water and cleaning solutions of water and soap against the dishes during wash and rinse cycles of the cleaning operation. While only one spray arm 30 is illustrated in FIG. 1, it will be understood by those skilled in the art that additional spray arms can be utilized, mounted along an inner surface or side of the top 16 of the cabinet or in other various positions as needed. The spray arm 30 generally includes two or more sections or ends 31 that extend radially outwardly from a central hub 32 and include a series of spray openings 33 formed at spaced locations therealong and through which the water and/or cleaning solution is sprayed against the dishes. The spray openings further can be aligned or oriented at varying angles to cover a desired spray area. The spray arm 30 generally is connected via a water line or pipe 34 to a pump, which can include or can be connected to a heater (not shown) within the dishwasher cabinet. The pump supplies heated water and/or cleaning solution to the spray arm under pressure, generally causing the spray arm to rotate as it sprays the heated water and/or cleaning and rinse solutions against the dishes during washing and rinsing cycles of the cleaning operation.

As further indicated in FIG. 1, the bottom 17 of the dishwasher chamber 15 can include sloped or inwardly tapering walls 36, which typically slope downwardly toward a drain 37. The sloping walls collect and direct water into the drain for removal from the wash chamber 12. A blower 40 also is mounted within the dishwasher cabinet 15, and generally includes a plenum or collector 41 through which air is drawn from the wash chamber during a drying cycle and thereafter is directed out of the dishwasher through a discharge opening 42 for exhaustion of such air from the wash chamber, as indicated by arrows 43. The operation of the blower 40 during the drying cycle of the dishwasher cleaning operation creates a low pressure within the wash chamber 12, which in turn causes a drying air flow, indicated by arrows 46 in FIG. 1, of cooler, drier air to be drawn into the wash chamber through the drying system 10 of the present invention.

As indicated in FIG. 1, the drying system 10 generally will be mounted to an upper surface 47 of the top 16 of the dishwasher cabinet 15 for drawing drying air flows 46 therethrough and into the wash chamber 12. As previously noted, the drying system 10 of the present invention does not require a connection to a power source or to be directly connected to the pump or blower of the dishwasher for its operation. During the drying cycle, when the pressure within the wash chamber is lowered by operation of the blower 40, the drying system 10 will pull or draw a flow of cool, drier air into the wash chamber, which flows of air 46 will be circulated through the wash chamber, typically in a spiraling flow or expanding fashion as indicated by arrows 48 in FIG. 1, to assist in drying the dishes therein. During the washing and final rinse cycles of a dishwasher cleaning operation, when the pressure within the wash chamber is generally at an increased or higher level, and a hot, moist environment is created within the wash chamber, the drying system 10 will create or form beads or bubbles of water that thus define a moisture barrier, indicated by phantom lines 49 in FIG. 4B, so as to substantially seal the openings of the air vents and accordingly block and substantially prevent outside air from entering the wash chamber 12, and to further prevent the escape or leakage of heated, moist air and water from the wash chamber during the washing and rinsing cycles of the cleaning operation.

The drying system 10 is illustrated in further detail in FIGS. 2-4A and generally includes a passive vent assembly 50 mounted along the upper surface of the top of the dishwasher cabinet. The passive vent assembly 50 includes a passive vent structure 51 for regulating and/or controlling the inflow of air 46 (FIG. 1) through the passive vent assembly 50 and into the wash chamber 12 of the dishwasher 11, a diffuser 52 attached to the bottom of the passive vent structure and a trap hood or cover 53 attached to the top of the passive vent structure.

Figure 2:
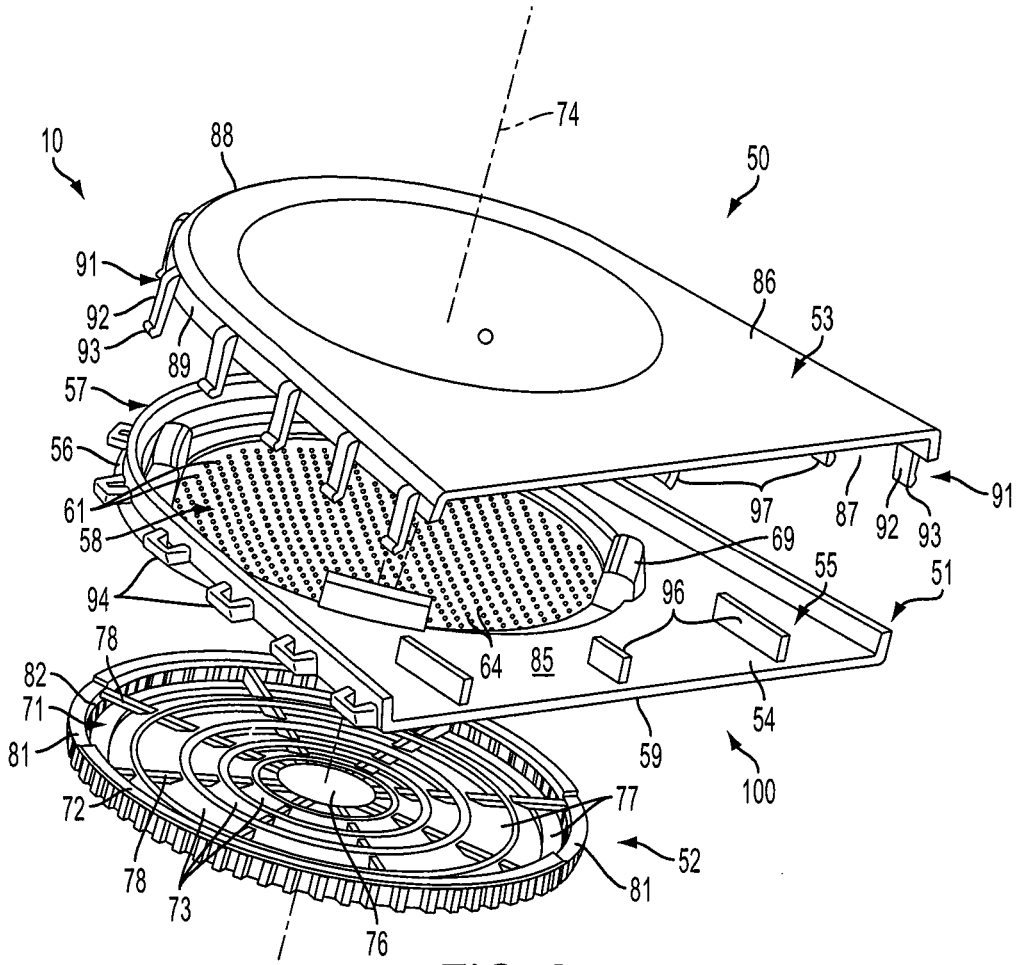
FIG. 2 is an exploded perspective view of one embodiment of the drying system of the present invention.
Figure 4A:
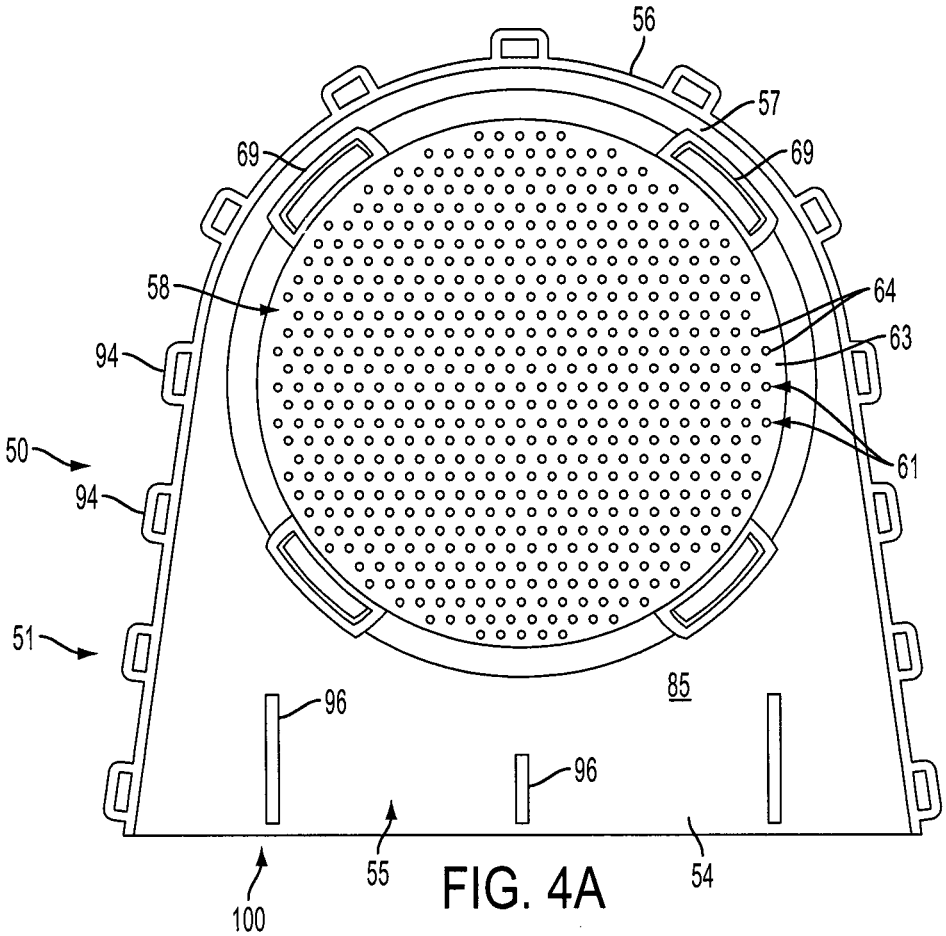
FIG. 4A is bottom view of a passive vent structure of the drying system.

As generally indicated in FIGS. 2 and 4A, the passive vent structure 51 includes a body 55, sandwiched between the diffuser 52 and moisture trap hood 53, and here shown as having a substantially U- or C-shaped appearance with an outwardly flaring front first or proximal end 54 that is open to the surrounding ambient environment about the cabinet of the dishwasher, a rounded or substantially arcuate rear, second or distal end 56, with an upwardly projecting rim or side wall 57 extending thereabout. Other configurations also can be used as needed or desired. A vent section 58, here shown as having a substantially circular construction, generally is formed adjacent the rear or distal end 56 of the body 55, typically spaced from the front or proximal end 54 of the body at desired spacing. The vent section 58 further typically is recessed within and extends or projects downwardly from a bottom surface 59 of the body of the vent structure 51, as indicated in FIG. 2, so as to project into the wash chamber 12 (FIG. 1) of the dishwasher.

Figure 3:
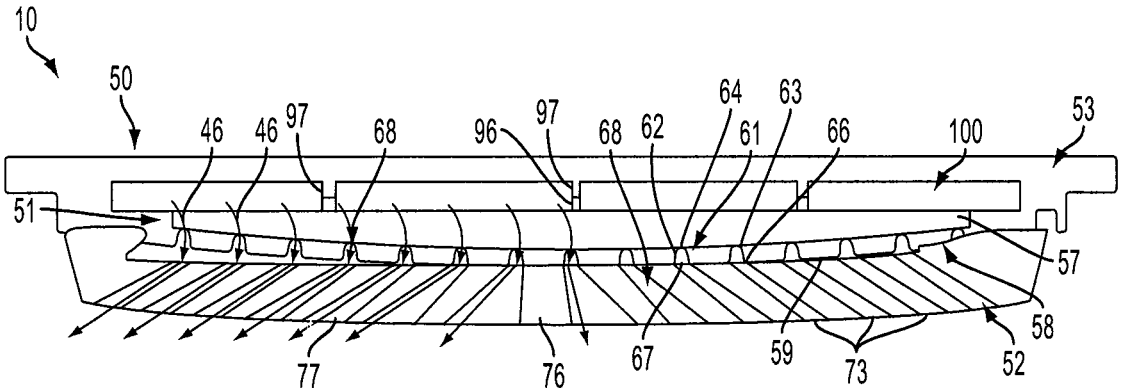
FIG. 3 is a cross sectional view of one embodiment of the drying system of the present invention.
Figure 4B:
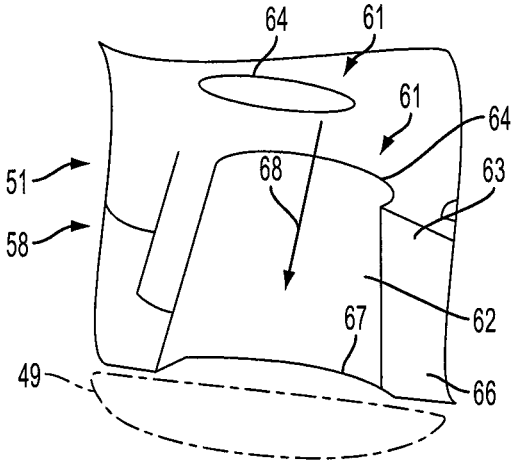
FIG. 4B is a close-up perspective view illustrating the design of an air vent or inlet of the passive vent structure of the drying system.

A series of air vents or inlets 61 (FIG. 2) are formed in the vent section 58 of the body 55 of the passive vent structure 51, typically being formed at spaced intervals thereacross. As indicated in FIGS. 3 and 4B, each of the air vents 61 generally has a conical structure, although other configurations such as trapezoidal, pyramidal or the like also can be used. In the embodiment illustrated in FIGS. 3 and 4B, each of the air vents 61 generally includes a side wall 62 having an upper end 63 at which is defined an upper vent opening 64, and a lower end 66 defining a lower vent opening 67. The air vents and tapering side walls thereof thus define flow passages 68 for the ingress of the drying air flows 46 (FIG. 1) into the wash chamber 12.

As illustrated in FIG. 4B, the upper vent opening 64 of each of the air vents 61 generally is of a smaller size than its corresponding lower vent opening 67 such that the side wall 62 has a tapering construction as it extends from the lower vent opening to the upper vent opening 64. For example, the upper vent openings can range in diameter from approximately 0.040-0.050 inches up to approximately 0.070-0.090 inches, while the lower vent openings can range in diameter from approximately 0.080 inches up to approximately 0.15 inches. It will, however, be understood by those skilled in the art that the upper and lower vent openings further can be of greater or lesser sizes and that the air vents 61 further can be formed with a variety of different configurations in accordance with the principles of the present invention, while maintaining the tapering configuration of the air vents or inlets to facilitate the capture of moisture and sealing of the air vents during washing and rinsing cycles of the dishwasher operation.

As indicated in FIGS. 2-4A, a series of clips or snapping connectors 69 generally are formed in the body 55 of the passive vent structure 51 adjacent the vent section 58. The drawings illustrate four snapping connectors 69 arranged at spaced intervals about the vent section 58; however, it will be understood by those skilled in the art that fewer or greater numbers of connectors also can be used as needed. The diffuser 52, here shown as having a substantially circular construction substantially matching the configuration of the vent section 58, will be received over the vent section of the body of the passive vent structure, by engagement with the snapping connectors 69, with the diffuser facing into the wash chambers of the dishwasher.

The diffuser 52 generally will have a configuration similar to that of the vent section over which it is placed, and in the present embodiment, is illustrated as having a flat, substantially circular body 71 with a circular rim or outer edge 72. A series of radially spaced fins or baffles 73 are arranged at concentrically spaced intervals from a central axis 74 that extends vertically through the center or hub 76 of the diffuser 52 and through the center of the vent section 58 of the body 55 of the passive vent structure 51 and the moisture trap hood 53 as indicated in FIG. 2. The fins 73 are spaced apart so as to define openings 77 through which the incoming drying air flows 46 are diffused and spread through the wash chamber.

As also indicated in FIGS. 2 and 3, the fins 73 are arranged in concentric rings or rows and generally are oriented at varying angles. Preferably, the fins are oriented at angles of approximately 10° to 80° with respect to the central axis 74, although it will be understood by those skilled in the art that greater or lesser angles of orientation of the fins also can be utilized. In addition, the angle(s) of the fins with respect to the central axis 74 typically will increase for each of the concentric rings of fins spaced further from the central axis 74, as generally illustrated in FIG. 3. As a result, as the drying air flow 46 is passed through the air vents 61 and through the corresponding openings 77 defined between each of the concentric fins 73, the air flow is spread and directed across a wider coverage area within the wash chamber of the dishwasher as indicated in FIG. 1.

As further indicated in FIG. 2, the concentric rings of fins 73 are supported by ribs 78 that extend radially outwardly from the center or hub 76 of the diffuser 52, which ribs provide structural support and rigidity to the concentric rings of fins. Additionally, connector portions 81 generally are defined about the inner surface 82 of the rim 72 of the diffuser body 71. Such connector portions 81 will engage the corresponding snapping connectors 69 of the passive vent structure so as to lock the diffuser to the body of the passive vent structure in a position overlying the vent section 58, as illustrated in FIG. 3. As a result, as the air flow (indicated by arrows 46 in FIG. 3) enters the passive vent assembly 50 and is passed/drawn through the air vents 61, the air flows further will be diffused and spread by the angled fins of the diffuser so as to cause the air flow to be spread across a wider area within the wash chamber and thus create further turbulence and diffusion of the air so as to cover more area within the wash chamber of the dishwasher to facilitate quick condensation and rapid movement of air on and across the dishes within the wash chamber.

As indicated in FIG. 2, the moisture trap hood or cover 53 generally is mounted over the upper surface 85 of the body 55 of the passive vent structure 51. The moisture trap hood typically will have a configuration that substantially matches the configuration of the passive vent structure 51, and includes a body 86 having an open or outwardly flaring front, first or proximal end 87, a rear, second or distal end 88, and a downwardly projecting rim or side wall 89. A series of downwardly extending connectors 91, here shown as snapping type connectors each comprising a flexible leg 92 terminating in an outwardly flared catch portion 93, engage mating receptacles or connectors 94 formed in spaced series about the upwardly extending side wall or rim 57 of the body 55 of the passive vent structure 51 to lock the moisture trap hood into engagement over the upper surface 85 of the passive vent structure as illustrated in FIG. 3.

As further illustrated in FIG. 2, the passive vent structure also generally includes a series of upwardly extending partitions or supports 96 projecting from its upper surface 85, while the moisture trap hood 53 similarly includes a series of downwardly projecting partitions or supports 97. These partitions or supports 96 and 97 of the passive vent structure and moisture trap hood, respectively, engage one another to support the moisture trap hood in an arrangement spaced above the upper surface 85 of the passive vent structure. The spacing of the moisture trap hood above the passive vent structure can be varied, for example ranging from approximately ¼-½ inch up to approximately 1 inch, although greater or lesser spacings also can be used as desired, to provide for a desired airflow volume into the drying airflow opening 100 defined between the moisture trap head 53 and the passive vent assembly 51, while also assisting in the capture or trapping of warm moist air that may leak out during the transition from a wash cycle to a drying cycle, to promote the trapping and condensation of such water vapor into droplets that can be directed into the air vents or inlets 61 of the passive vent structure so as to form a moisture barrier across the air vents of the passive vent structure during wash and rinse cycles of a cleaning operation as the pressure within the wash chamber is at a higher level.

The components of the passive vent assembly 50, including the passive vent structure 51, diffuser 52 and moisture trap hood or cover 53, are formed from a lightweight, low surface energy material that promotes surface adhesion of water beads or bubbles thereon. Generally, such materials can include low surface energy plastics such as polypropylenes, polyethylenes, high density polyethylenes, polystyrenes, polytetrafluoro ethylenes (such as Teflon® or Tedlar®), polyvinyl fluorides, ethylene-vinyl acetate materials, and/or other similar materials. As a further alternative, materials such as various other composite or synthetic materials, metals, glass or other similar materials also can be used, and can be coated with a low surface energy coating material such as polytetrafluoro ethylenes (such as Teflon® or Tedlar®), or other similar low surface energy materials, waxes, various types of paints such as acrylic paints or adhesives, and/or other coatings that will promote adhesion and beading up of water on the surface of the vent section of the passive vent assembly.

As a result, the formation and retention of water bubbles or beads over the lower vent openings of each of the air vents of the vent section of the passive vent structure is facilitated. The tapering side walls of the air vents tend to constrict rising humid, moist air, facilitating formation of water bubbles at the lower ends of the air vents, while the low surface energy material of the passive vent assembly works with surface tension to hold the thus formed water bubbles in place over the openings of the air vents to create a substantially moisture tight seal during the washing and rinsing cycles of the dishwasher cleaning operation. The high pressure within the wash chamber during a washing and rinsing cycle also assists in the sealing of the air vents and prevent ingress of cold, drier air through the air vents during the washing and rinsing cycles of the dishwasher operation.

At the end of a cleaning and final rinse operation of the dishwasher, as the drying cycle starts, the blower is engaged and begins to draw an airflow from the wash chamber. This creates a lower pressure within the wash chamber that causes drying airflows 46 (FIG. 1) to be drawn into the airflow opening of the passive vent assembly 50 of the drying system 10. This lower pressure and inflow of drying air also helps disrupt or break the water beads/bubbles 49 (FIG. 4B) sealing the air vents 61 to promote substantially unrestricted flows of drying air therethrough. The drying airflows of cool, drier air are drawn through the air vents of the vent section of the passive vent structure 51, as indicated in FIG. 3, and thereafter are diffused or spread as they are introduced into the wash chamber by the angled fins or baffles of the diffuser 52. As a result, the incoming airflows are spread across the tub or wash chamber rather than being applied directly against the dishes. This diffusion of the incoming drying airflow and its mixing with the hot, moist air rising within the wash chamber helps create a turbulent or swirling airflow within the wash chamber.

In addition, the location of the air vents of the passive vent assembly at the top of the wash chamber together with the location of the blower and air outlet at the bottom of the dishwasher helps create a suction that causes the drier, colder air being introduced at the top of the wash chamber to be drawn and/or flow towards the bottom of the wash chamber against the rising movement of the hot, moist air within the dishwasher wash chamber, as indicated by arrows 48 in FIG. 1, which because of its tendency to rise to the top of the wash chamber, further tends to urge or otherwise force the colder, drier air toward the bottom of the wash chamber. This turbulent air flow, with the colder, drier air flowing against and mixing with the hot, moist air, promotes quick condensation of the moisture within the hot air inside the dishwasher wash chamber and provides a rapid movement of air across the dishes to facilitate efficient drying of the dishes.

The diffusion and corresponding wider coverage of the incoming drying airflows over the space within the wash chamber of the dishwasher further enables a reduction in the space required for the passive vent assembly within the wash chamber while enabling expansion of coverage of the incoming drying air flows. Additionally, as previously noted, the passive vent assembly of the present invention does not require the use of additional power in order to operate, but rather provides enhanced and more efficient drying of the dishes when used in conjunction with a convention blower of the dishwasher. Thus, the drying cycle potentially can be reduced. In addition, the moisture trap hood, positioned over the upper vent openings of the air vents of the passive vent structure will help trap moist air exiting from the air vents, facilitating condensation thereof so that the moisture within the air will tend to condense and drip back to the vent holes, which droplets can further help form bubbles or similar water/moisture sealing effects across the air inlet openings.

The foregoing description of the disclosure illustrates and describes various embodiments. As various changes can be made to the above construction without departing from the spirit and scope of the present invention as disclosed herein, it is intended that all matter contained in the above description or shown in the accompanying drawings shall be interpreted as illustrative and not in a limiting sense. Furthermore, the scope of the present disclosure shall be construed to cover various modifications, combinations, alterations, etc. of the above-described embodiments that are within the scope of the claims of this application.

Additionally, while the disclosure shows and describes selected embodiments of the present invention, the invention is capable of use in various other combinations, modifications, and environments, and is capable of undergoing a variety of changes or modifications than the scope of the inventive concepts as expressed herein, commensurate with the above teachings, and/or within the skill or knowledge of the relevant art. Furthermore, various features and characteristics of each embodiment may be selectively interchanged and applied to the other illustrated and non-illustrated embodiments of the disclosure.

The invention claimed is:

1. A drying system for drying dishes within a wash chamber of a dishwasher comprising:

a passive air entrance vent assembly mounted along an upper portion of the dishwasher and in communication within the wash chamber of the dishwasher for supplying a drying flow of air into the wash chamber for drying dishes therein, the passive air entrance vent assembly comprising:

a passive air entrance vent structure including a body defining a vent section having a series of air vents formed therein, wherein the air vents each include a side wall having an upper end defining an upper vent opening, and a lower end defining a lower vent opening, the lower vent opening being of a size greater than the upper vent opening such that the side wall tapers from its lower end to its upper end; and a diffuser mounted to the passive air entrance vent structure along a lower surface of the vent section of the body of the passive air entrance vent structure and including a series of fins defining air flow passages for spreading the drying flow of air across the wash chamber;

wherein during a wash cycle, beads of moisture will form across the air flow passages of the air vents of the passive air entrance vent structure to create a moisture seal at the upper vent openings thereof and substantially prevent air from entering the wash chamber through the air vents, while during a drying cycle, the beads of moisture are broken to enable dry air to be drawn into the wash chamber, with the dry air moving through the wash chamber from top to bottom to promote condensation and rapid movement of air across the dishes.

2. The drying system of claim 1 and further comprising a moisture trap hood mounted over an upper surface of the passive air entrance vent structure, and defining an air flow inlet for drawing the drying flow of air into the air flow passages of the air vents of the passive air entrance vent structure.

3. The drying system of claim 1 and wherein the fins of the diffuser are spaced radially and each are oriented at an angle of approximately 10° to approximately 80° with respect to a central axis of the diffuser.

4. The drying system of claim 3, wherein the angle of the fins increases with respect to the central axis of the diffuser the further the fins are spaced radially outwardly from the central axis of the diffuser.

5. The drying system of claim 1 and wherein air vents are substantially conically shaped and the upper vent openings of the air vents comprise a diameter of approximately 0.050 inches to approximately 0.090 inches, and the lower vent openings of the air vents comprise a diameter of approximately 0.10 inches to approximately 0.15 inches.

6. The drying system of claim 1 and wherein the passive air entrance vent structure is formed from a low surface energy material adapted to promote surface tension with moisture within the wash chamber to hold the beads of moisture in place over the air flow passages to form the moisture seal.

7. The drying system of claim 6 and wherein the low surface energy material of the passive air entrance vent structure comprises polypropylene, polyethylene, high density polyethylene, polystyrene, polytetrafluoroethylene, polyvinyl fluoride or ethylene-vinyl acetate.

8. A dishwasher for cleaning dishes comprising:

a cabinet having a top, a bottom, and a series of walls defining a wash chamber in which the dishes are received for cleaning;

a spray arm mounted within said wash chamber for applying fluids to the dishes for cleaning the dishes;

a blower in communication with said wash chamber for drawing air from said wash chamber for drying the dishes within the wash chamber; and a passive air entrance vent assembly mounted along said top of said cabinet and comprising:

a passive air entrance vent structure having a body with a first end open. to an ambient environment surrounding said cabinet and defining an air flow inlet, a second end, and a vent section formed. adjacent said second end and having a series of air vents formed therethrough and through which drying air flows are drawn into said. wash. chamber, wherein said passive air entrance vent structure is formed from a low surface energy material and said air vents are formed with a configuration that tapers from a lower end to an upper end thereof to facilitate capture of moisture and formation of bubbles thereon to thus form a moisture seal over said air vents during washing and rinse cycles of the dishwasher, and a diffuser mounted over said vent section of said passive air entrance vent structure and projecting into said wash chamber of said cabinet, said diffuser including a series of spaced fins defining openings for directing the drying air flows from said air vents across said wash chamber.

9. The dishwasher of claim 8 and wherein the air vents are substantially conically shaped and the upper vent openings of the air vents comprise a diameter of approximately 0.050 inches to approximately 0.090 inches, and the lower vent openings of the air vents comprise a diameter of approximately 0.10 inches to approximately 0.15 inches.

10. The dishwasher of claim 8 and wherein the low surface energy material of the passive air entrance vent structure comprises polypropylene, polyethylene, high density polyethylene, polystyrene, polytetrafluoroethylene, polyvinyl fluoride or ethylene-vinyl acetate.

11. The dishwasher of claim 8 and wherein said low surface energy material of said passive air entrance vent structure comprises a plastic, metal, glass or synthetic material coated with a low surface energy coating to promote formation of beads of moisture thereon.

12. The dishwasher of claim 8 and further comprising a moisture trap hood mounted over an upper surface of the passive air entrance vent structure, and defining the air flow inlet for drawing the drying air flows into the openings of the air vents of the passive air entrance vent structure.

13. The dishwasher of claim 8 and wherein the fins of the diffuser are spaced radially and each are oriented at an angle of approximately 10° to approximately 80° with respect to a central axis of the diffuser.

14. The dishwasher of claim 13 wherein the angle of the fins increases with respect to the central axis of the diffuser the further the fins are spaced radially outwardly from the central axis of the diffuser.

* * * * *